US006027615A

United States Patent [19]

Davenport et al.

[11] Patent Number: 6,027,615

[45] Date of Patent: Feb. 22, 2000

[54] BELTS FOR COMPLIANT CALENDERING

[75] Inventors: Francis L. Davenport, Ballston Lake; William H. Dutt, Wynantskill, both of N.Y.

[73] Assignee: Albany International Corp., Albany, N.Y.

[21] Appl. No.: 08/851,966

[22] Filed: May 6, 1997

[51] Int. Cl.[7] ..... D21F 3/00

[52] U.S. Cl. ..... 162/358.2; 162/358.3; 162/358.4; 162/900; 162/901; 442/281

[58] Field of Search ..... 162/348, 358.2, 162/358.3, 358.4, 900, 901; 442/278, 281, 319, 381, 387, 388, 389

[56] References Cited

U.S. PATENT DOCUMENTS

| | | | |
|---|---|---|---|
| 4,427,734 | 1/1984 | Johnson | 428/234 |
| 4,567,077 | 1/1986 | Gauthier | 428/114 |
| 5,360,656 | 11/1994 | Rexfelt et al. | 428/193 |
| 5,753,085 | 5/1998 | FitzPatrick | 162/358.4 |

*Primary Examiner*—Christopher Raimund
*Attorney, Agent, or Firm*—Kane, Dalsimer, Sullivan and Levy, LLP

[57] ABSTRACT

A calender belt for the compliant calendering of a paper web includes an endless base substrate, a staple fiber batt attached to at least the outside of the endless base substrate, and a polymeric resin material totally impregnating the fiber/base composite structure comprising the endless base substrate and the staple fiber batt to a substantially uniform depth. That depth may be such that the polymeric resin material does not reach the base substrate, or partly or completely impregnates the base substrate. A layer of polymeric resin material is built up upon the staple fiber material to a predetermined thickness. Once the polymeric resin material is cured, it is ground to a desired smoothness without exposing any fiber on the ground surface. That the penetration of the polymeric resin material into the staple fiber batt, and possibly into the base substrate, is to a uniform depth enables the calender belt to provide a uniform pressure pulse as it passes with a paper web through the nip in a compliant calender.

31 Claims, 5 Drawing Sheets

BELTS FOR COMPLIANT CALENDERING

BACKGROUND OF THE INVENTION

1. Field of the Invention

The present invention generally relates to the calendering of a web of paper, paperboard or the like. More specifically, the invention relates to a calender belt, of the kind used on a calendering system at the downstream end of a paper machine or on an off-machine calender, which passes, together with the web, through a calender nip to provide a desired finish to the web.

2. Description of the Prior Art

Paper or paperboard is calendered during manufacture in order to be provided with increased surface smoothness and gloss. Calendering is required to provide many printing papers with a desired printing quality, and may be carried out on both coated and uncoated paper or paperboard.

Calendering may be performed on-line on a papermaking or board machine immediately after the dryer section thereof. In on-line calendering, a machine calender comprising at least one calender nip formed between two hard rolls may be used. Machine calendering is also known as hard calendering, because both press rolls are hard.

Calendering can also be performed off-line, substantially separate from the papermaking or board machine. In such case, use is traditionally made of a so-called supercalender, which comprises a relatively large number of rolls arranged in a vertical stack. Usually, every other roll in a supercalender is hard, and those between the hard rolls are of a softer material, so that the side of the web contacting the hard rolls receives increased gloss. A more uniform treatment of the web can be achieved if the relative positions of the hard and soft rolls are exchanged at the center of the supercalender, so that the side of the web originally contacting the soft rolls may contact the hard rolls.

Calenders with elastic rolls, or soft calenders, have also been developed for on-line calendering. A soft calender, also known as a compliant calender, can be disposed on-line after the papermaking or board machine or a coating unit, and normally has a relatively small number or rolls. In compliant calendering, each nip is formed between a heated steel roll and an associated elastic roll, such as a polymer-coated roll. Heat, which makes the web soften in the nip, is supplied to make the paper web as smooth and glossy as it would become if a supercalender were used. The elasticity of the elastic roll in a soft calender permits the press nip to become somewhat extended. In turn, this extension leads to a flattening of the pressure pulse relative to that of a machine calender, so that the compression on the paper web can advantageously be limited as compared with that in a machine calender.

The results obtained in machine (hard) calendering, using two hard rolls, and compliant (soft) calendering, using one hard, heated roll and one elastic roll, are different from one another. A machine calender with hard rolls calenders to a constant web thickness. The undesired consequence of constant web thickness is a non-uniform density in the calendered web because the high, localized pressure pulse imparted in the press nip gives a comparatively stronger compression to the thicker portions of the web. A compliant calender, however, calenders to a more constant web density. The consequence, however, is a web which is not of uniform thickness, and can have poorer gloss and smoothness.

In either case, the calendered paper sheet is non-uniform in some respect. Accordingly, it may be necessary, depending on the contemplated use of the calendered paper or paperboard, to make a trade-off between non-uniform thickness and non-uniform density, as each has its own effect on the quality of the images printed on the paper or paperboard.

Compliant (soft) calenders which incorporate an endless calender belt, rather than a polymer-coated roll, have been developed. The calender belt passes in an endless path around a roll which forms a pressure nip with a hard roll. In operation, the paper or paperboard web is located in the nip between the elastic, endless belt and the hard roll. A benefit of this design can be that the calender belt, which is heated in the nip by heat from the heated, hard roll, can be cooled during its return in the closed loop.

Calenders of substantially the same design as long nip presses for the press sections of paper machines have also been used in compliant calendering. Compliant calenders of this type have an extended nip formed between a rotating and often heated hard roll and a matching, substantially stationary, concave support element or press shoe. The paper or paperboard web passes through the nip along and in contact with a support medium in the form of an endless calender belt, which in the nip is located between the web and the support element or shoe. The calender belt passes in an endless path around the support element or shoe and, as in this kind of press in a press section, must be impermeable on the shoe side also.

Endless calender belts for soft calendering are traditionally made of a woven base structure impregnated to a desired thickness, either on one or both sides, with a suitable impregnating substance, generally polyurethane. It will be appreciated, in view of the preceding discussion on the effects calendering has upon a paper web, that the properties of the calender belt must be uniform in order not to introduce or to worsen non-uniformities in the calendered paper web. Since the paper or paperboard web is in direct contact with the calender belt, it must have a very smooth surface to impart the desired finish characteristics to the paper or paperboard web. In particular, the elastic modulus and the elastic deformation/recovery in the Z-direction, that is, the direction perpendicular to the plane of the calender belt, must be proper and uniform to ensure that all parts of the paper web experience the same pressure pulse in the pressure nip.

Heretofore, one of the shortcomings of the calender belts currently in use has been a non-uniform structure. The principal reason for the difficulty in providing a uniform structure, it has been discovered, is that the polymeric impregnating substance does not uniformly impregnate the base of the calender belt. As a consequence, the response of the calender belt to compression varies across the surface of the calender belt. In turn, these variations cause the shape of the pressure pulse at points across the pressure nip to vary periodically, and, as a consequence, cause the thickness, density, smoothness and gloss of the calendered paper web to be non-uniform.

A second shortcoming of the calender belts currently in use is a lack of structural integrity. In any coated fabric having a resin coating mechanically bonded to the yarns of a woven base structure, delamination of the resin coating can occur. If the resin coating is applied in more than one layer, such as in a multiple thin pass (MTP) process, there is also the possibility of interlayer delamination caused by shear stresses imposed on the calender belt as it passes through the nip of the calender, or at specific locations across the nip known as stress concentrators. These locations can be at roll edges; a roll surface where the surface "dubbing" is slightly incorrect; or at the shoe edges, where the calender belt may take a complex bend.

Another shortcoming of the calender belts currently in use is stress cracking and crack propagation within the resin coating. This consequence of fatigue in the resin coating usually begins at the location of a stress concentrator, or may just be due to a combination of shear and compressive fatigue. Hysteresis can also be a factor. Once cracks begin to appear, they can propagate across the surface and deepen into the resin coating, eventually allowing pieces of the resin coating to wear away quickly and nonuniformly, and necessitating the removal and replacement of the calender belt.

Still another shortcoming of the calender belts currently in use is that there is an upper limit to the thickness of the resin coating that can be applied. An overly thick layer is susceptible to failure due to shear forces and hysteresis. Yet a thick layer is often needed to meet the requirements of a particular calender nip and/or the paper grade properties being developed.

The present invention is an improved calender belt compared to the calender belts of the prior art, and represents a solution to the above-noted deficiencies of those calender belts.

SUMMARY OF THE INVENTION

Accordingly, the calender belt of the present invention comprises a base substrate, a staple fiber batt attached to the base substrate, thereby providing a fiber/base composite structure comprising the base substrate and staple fiber batt, and a polymeric resin material impregnating the fiber/base composite structure to a substantially uniform depth and forming a layer on at least one side of the fiber/base composite structure, that side being the top side, which is the outer side of the endless loop form of the calender belt. The calender belt of the present invention is impermeable.

The base substrate may be any one of the structures used as bases for paper machine clothing, such as a woven, nonwoven, braided or knitted fabric, an extruded sheet of polymeric resin material, an extruded mesh fabric, or a spiral-link fabric. The base substrate may also be assembled from a strip of one of these materials spirally wound in a plurality of turns, each turn being joined to those adjacent thereto by a continuous seam, the base substrate thereby being endless in a longitudinal direction.

The base substrate may also be a laminated structure comprising two or more base layers, each of which may be one of the structures described above. Where the base substrate is laminated, one of the component base layers may be an on-machine-seamable fabric, so that the calender belt may be seamed into endless form during installation on a paper machine.

A staple fiber batt is attached to the base substrate, for example, by needling or hydroentangling. The staple fiber batt is attached to at least one side of the base substrate, that being the top side, and may be attached to both sides thereof. The attachment is carried out so as to leave a layer of staple fiber batt on at least the top side, but preferably on both sides, of the base substrate.

A polymeric resin material is then applied to at least the side of the fiber/base composite structure having the staple fiber batt attached thereto, or to at least the top side of the fiber/base composite structure where staple fiber batt is attached to both sides, and allowed to penetrate thereinto to a substantially uniform depth. That depth may be chosen to be within the staple fiber batt but not reaching the base substrate. A layer of the polymeric resin material is also built up above the surface of the fiber/base composite structure to ensure its total coverage by the polymeric resin material. After curing, some of the polymeric resin material is removed by grinding and/or polishing to achieve a desired smoothness without exposing any of the fiber/base composite structure on the polished side.

Alternatively, the polymeric resin material may be allowed to penetrate into the base substrate or completely through the base substrate to the other side of the fiber/base composite structure. The other side of the fiber/base composite structure may also be coated with a polymeric resin material of the same or of a different type.

The steps of this coating procedure may alternatively be reversed by applying the polymeric resin material first from the other, or back, side, and by allowing it to penetrate to a uniform depth within the fiber/base composite structure from that side. The first, or top, side of the fiber/base composite structure is then coated, so that the fiber/base composite structure is not only completely impregnated by the polymeric resin material, but is also covered by a layer of polymeric resin material.

Layers of polymeric resin material may be built up on each side of the fiber/base composite structure. Once the polymeric resin material is applied to a desired thickness, it is ground to achieve a desired smoothness on one or both sides without exposing any of the fiber/base composite structure on the polished side or sides thereof.

The present calender belt, with its uniform fiber-reinforced polymeric resin matrix, provides a uniform pressure pulse in the nip to the paper web being calendered, and has a longer life potential than calender belts currently in use. In this regard, it provides a solution to the problems associated with the calender belts of the prior art.

The present invention will now be described in more complete detail with appropriate reference being made to the accompanying figures.

DETAILED DESCRIPTION OF THE PREFERRED EMBODIMENTS

Figure 1:
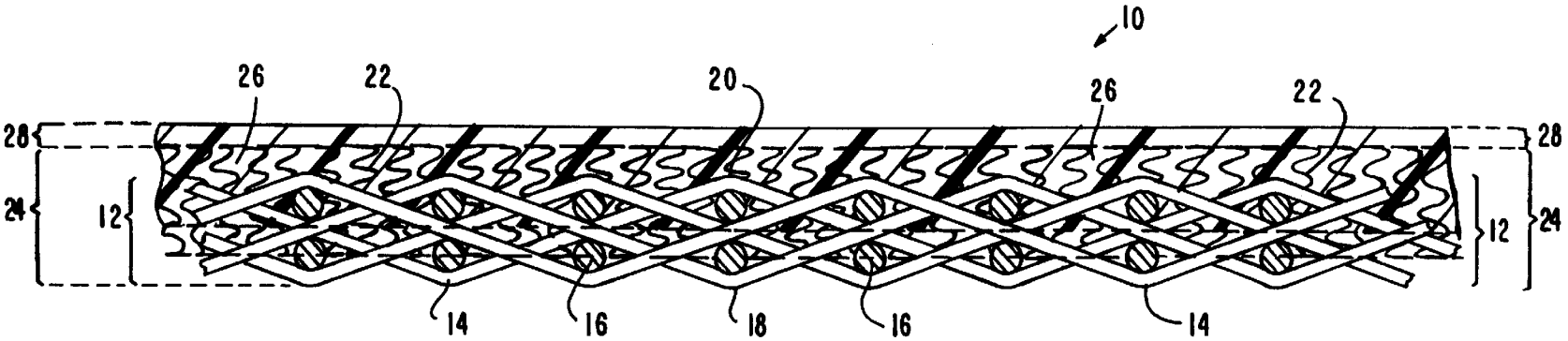
FIG. 1 is a cross-sectional view of a first embodiment of the calender belt of the present invention.

The calender belt of the present invention comprises three principal elements: a base substrate; batt fiber attached to the base substrate, the base substrate and batt fiber together being a fiber/batt composite structure; and a polymeric resin applied to the fiber/batt composite structure.

The base substrate may be a woven, nonwoven, knitted or braided structure of yarns of the varieties used in the production of paper machine clothing, such as monofilament, plied monofilament and/or multifilament yarns extruded from polymeric resin materials. Resins from the families of polyamide, polyester, polyurethane, polyaramid and polyolefin resins may be used for this purpose.

The base substrate may also be extruded from a polymeric resin material of the varieties mentioned above in the form of a sheet or membrane, which may subsequently be provided with holes or perforations. Alternatively, the base substrate may be composed of mesh fabrics, such as those shown in commonly assigned U.S. Pat. No. 4,427,734 to Johnson, the teachings of which are incorporated herein by reference. The base substrate may also be a spiral-link belt of the variety shown in many U.S. patents, such as U.S. Pat. No. 4,567,077 to Gauthier, the teachings of which are incorporated herein by reference.

Further, the base substrate may be produced by spirally winding a strip of woven, nonwoven, knitted, braided, extruded or mesh material according to the methods shown in commonly assigned U.S. Pat. No. 5,360,656 to Rexfelt et al., the teachings of which are incorporated herein by reference. The base substrate may accordingly comprise a spirally wound strip, wherein each spiral turn is joined to the next by a continuous seam making the base substrate endless in a longitudinal direction.

Finally, the base substrate may be a laminated structure comprising two or more base layers, each of which may be a structure of one of the preceding types.

Once the base substrate has been manufactured, batt fiber is applied to one or both of its two sides. Conventionally, the batt fiber is attached to the base substrate by needling (fiber locking). Alternatively, other methods, such as heat fusing, hydroentangling, melt fiber, or fusible fiber layers, could be used to attach the batt fiber. In heat fusing, standard batt fiber materials are applied to the base substrate and attached thereto upon exposure to heating at a temperature above their melting point. In melt fiber methods, fibers of lower melting point are mixed or blended with standard batt fiber materials and the batt produced from the mixture or blend is applied to the base substrate and attached thereto upon exposure to heating at a temperature above the melting point of the fibers of lower melting point but below the melting point of the standard batt fiber materials. In fusible fiber layer techniques, a batt of lower melting point fibers is sandwiched between batts of standard batt fiber materials. All are applied to the base substrate and are attached thereto by needling and by exposure to heating at a temperature above the melting point of the lower melting point fibers but below the melting point of the standard batt fiber materials.

A polymeric resin system, such as a polyurethane resin system, is then applied to the surface of the fiber/base composite structure to which the batt fiber is attached and allowed to penetrate from that surface to a substantially uniform depth within the fiber/base composite structure. The substantially uniform depth may be to any point within the structure, including completely through the structure, as well as completely through any batt fiber attached to the other surface of the base substrate. In such a case, the entire base substrate and all batt fiber would be totally encapsulated within the polymeric resin material. The batt fiber attached to the base substrate, in any event, allows the depth of penetration by the resin into the fiber/base composite structure to be more precisely controlled, and ensures that the depth will be substantially uniform. The size, weight and density of the batt fibers aid in controlling resin penetration. If penetration of the resin into the base substrate is to be avoided, batt fibers of appropriate size, weight and density can prevent such penetration. The other surface of the base substrate, with or without batt fiber, may also be coated separately. In either case, the resin material is applied to a thickness above the surface of the fiber/base composite structure so that in the subsequent grinding and/or polishing of the surface or surfaces of the resin coating, no part of the fiber/base composite structure is exposed.

The polymeric resin system may be applied by any one of several well-known techniques. In one such technique, known as the multiple thin pass (MTP) technique, a coating bar extending across the full width of the fiber/base composite structure is used to apply a uniformly thick layer of the polymeric resin material at once across the full width. Subsequent layers of resin can be applied to build up appropriate thickness, each time raising the coating bar by a desired amount. Subsequent resin layers can be of different formulation or hardness depending on requirements.

In another technique, known as the single pass spiral (SPS) technique, a narrow strip of resin is applied to an endless fiber/base composite structure in a continuous spiral manner. Subsequent layers of resin may be applied to one or both sides of the structure to build up a desired coating thickness.

A powder coating technique, in which a uniformly thick layer of polymeric resin material is applied to the fiber/base composite structure in powder form and subsequently fused by heating devices, such as infrared heating devices, may also be used as an alternative to the MTP and SPS techniques.

The preceding coating techniques may also be used in any combination with one another.

Once the desired amount of resin coating has been applied to one or both sides of the fiber/base composite structure, and the resin cured, the resin surface or surfaces may be ground to impart a surface smoothness of the degree required by the ultimate application for which the calender belt is intended.

Turning now to the several drawing figures, FIG. 1 is a cross-sectional view of a first embodiment of the calender belt 10 of the present invention. Calender belt 10 comprises a base substrate 12 woven in a duplex pattern from warp yarns 14 and weft yarns 16. The base substrate 12 may be woven endless, in which case weft yarns 16 will be oriented in the machine, or running, direction of the calender belt 10, or may be flat-woven and subsequently joined into endless form, in which case weft yarns 16 will be oriented in the cross-machine, or traverse, direction.

Assuming base substrate 12 to be in endless form, it has an inside 18 and an outside 20. In this first embodiment of the calender belt 10, a staple fiber batt 22 is attached to the outside 20 of the base substrate 12 and extends partly through the base substrate 12. Together, the base substrate 12 and staple fiber batt 22 form a fiber/base composite structure 24.

A polymeric resin material 26 is then applied to the outside 20 of the fiber/base composite structure 24 and penetrates to a uniform depth therewithin. A layer 28 of polymeric resin material 26 is built up above staple fiber batt 22. After the polymeric resin material 26 is cured, it is ground and/or polished to provide it with desired surface characteristics and the calender belt 10 as a whole with a uniform thickness. The grinding and/or polishing does not expose any fiber or yarn of the fiber/base composite structure 24, so that the calender belt 10 has a layer 28 of polymeric resin material 26 of desired thickness over the staple fiber batt 22.

Figure 2:
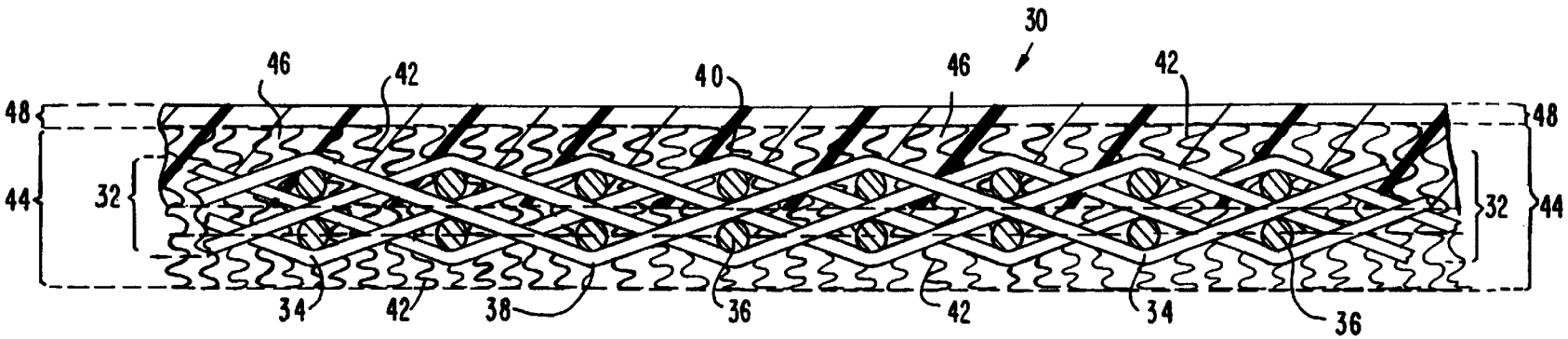
FIG. 2 is a cross-sectional view of a second embodiment of the calender belt.

FIG. 2 is a cross-sectional view of a second embodiment of the calender belt 30. As before, for the sake of illustration, calender belt 30 comprises a base substrate 32 woven in a duplex pattern from warp yarns 34 and weft yarns 36. Assuming base substrate 32 to be in endless form, it has an inside 38 and an outside 40.

In this second embodiment of the calender belt 30, a staple fiber batt 42 is attached to both the inside 38 and the outside 40 of the base substrate 32 and extends completely through the base substrate 32. Together, the base substrate 32 and staple fiber batt 42 form a fiber/base composite structure 44.

As in the first embodiment, a polymeric resin material 46 is then applied to the outside 40 of the fiber/base composite structure 44 and penetrates to a uniform depth therewithin. A layer 48 of polymeric resin material 46 is built up above staple fiber batt 42. As above, after the polymeric resin material 46 is cured, it is ground and/or polished to provide it with desired surface characteristics and the calender belt 30 as a whole with a uniform thickness. The grinding and/or polishing does not expose any fiber or yarn of the fiber/base composite structure 44, so that the calender belt 30 has a layer 48 of polymeric resin material 46 of desired thickness over the staple fiber batt 42.

Figure 3:
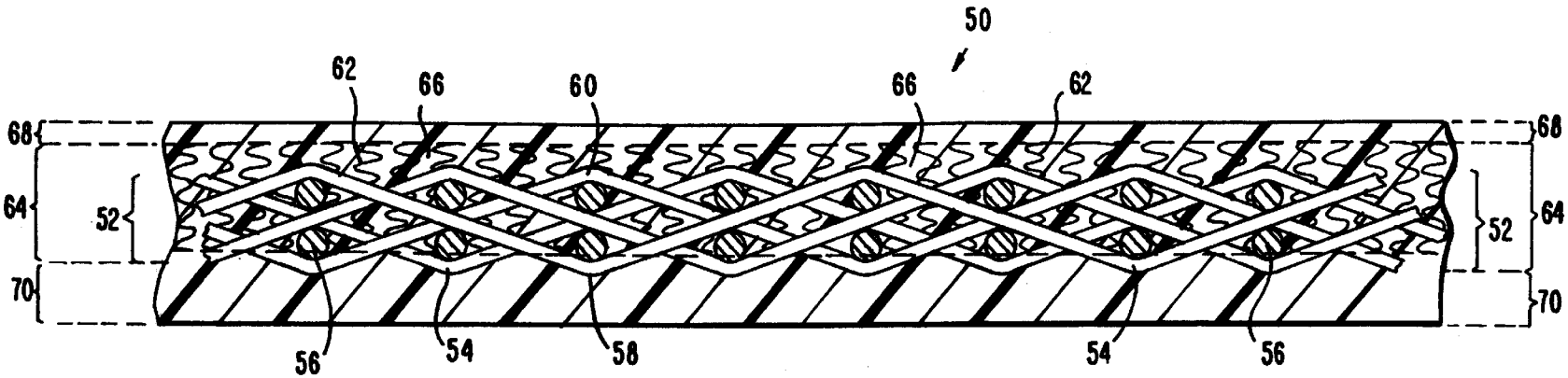
FIG. 3 is a cross-sectional view of a third embodiment of the calender belt.

FIG. 3 is a cross-sectional view of a third embodiment of the calender belt 50. Calender belt 50 again comprises a base substrate 52 woven in a duplex pattern from warp yarns 54 and weft yarns 56. Assuming base substrate 52 to be in endless form, it has an inside 58 and an outside 60.

In this third embodiment of the calender belt 50, a staple fiber batt 62 is attached to the outside 60 of the base substrate 52 and extends partly through the base substrate 52. Together, the base substrate 52 and staple fiber batt 62 form a fiber/base composite structure 64.

A polymeric resin material 66 is then applied to the outside 60 of the fiber/base composite structure 64 and penetrates completely therethrough to form a coating on the inside 58 of the fiber/base composite structure 64. A layer 68 of polymeric resin material 66 is built up above staple fiber batt 62. The coating process also leaves a layer 70 of polymeric resin material 66 on the inside of the fiber/base composite structure 64. After the polymeric resin material 66 is cured, both layer 68 and layer 70 are ground and/or polished, so that they may be provided with desired surface characteristics, and so that the calender belt 50 as a whole may be provided with a uniform thickness. The grinding and/or polishing does not expose any fiber or yarn on either the inside 58 or the outside 60 of the fiber/base composite structure 64, so that the calender belt 50 has a layer 68 of polymeric resin material 66 of desired thickness over the staple fiber batt 62 and a layer 70 of polymeric resin material 66 of desired thickness on the inside 58 of the fiber/base composite structure 64. Calender belt 50 is of the variety usable in both a roll-type and a shoe-type calender.

Figure 4:
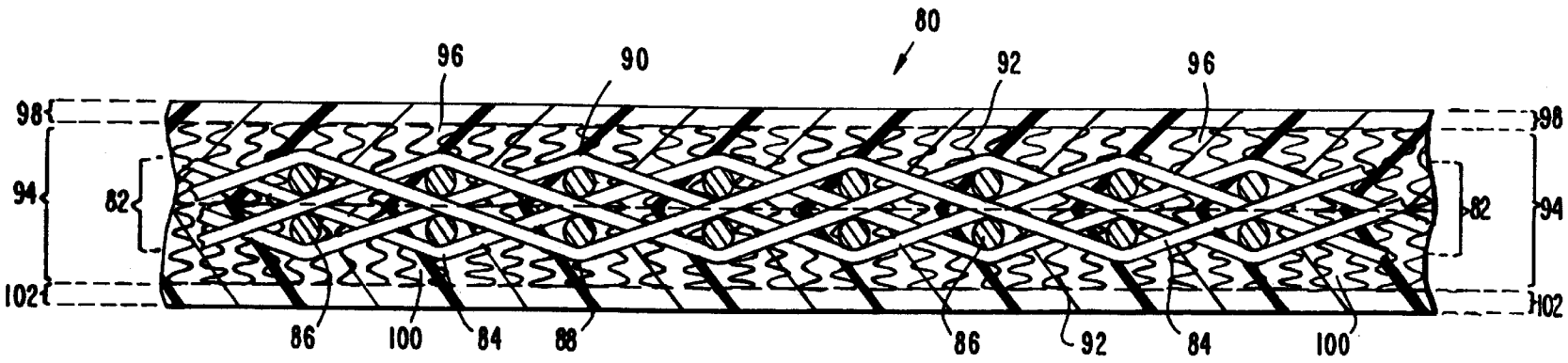
FIG. 4 is a cross-sectional view of a fourth embodiment of the calender belt.

FIG. 4 is a cross-sectional view of a fourth embodiment of the calender belt 80. Calender belt 80 again comprises a base substrate 82 woven in a duplex pattern from warp yarns 84 and weft yarns 86. Assuming base substrate 82 to be in endless form, it has an inside 88 and an outside 90.

In this fourth embodiment of the calender belt 80, a staple fiber batt 92 is attached to both the inside 88 and the outside 90 of the base substrate 82 and extends completely through the base substrate 82. Together, the base substrate 82 and staple fiber batt 92 form a fiber/base composite structure 94.

A polymeric resin material 96 is then applied to the outside 90 of the fiber/base composite structure 94 and penetrates to a uniform depth therewithin. A layer 98 of polymeric resin material 96 is built up above staple fiber batt 92 on the outside 90 of the fiber/base composite structure 94. After the polymeric resin material 96 is cured, it is ground and/or polished to provide it with desired surface characteristics and the calender belt 80 as a whole with a uniform thickness. The grinding and/or polishing does not expose any fiber or yarn of the fiber/base composite structure 94, so that the calender belt 80 has a layer 98 of polymeric resin material 96 of desired thickness over the staple fiber batt 92.

A polymeric resin material 100, either the same as or different from polymeric resin material 96, is then applied to the inside 88 of the fiber/base composite structure 94 and penetrate to a uniform depth therewithin. It should be understood, however, that the inside 88 of the fiber/base composite structure 94 could be coated first before the outside 90. A layer 102 of polymeric resin material 100 is built up below staple fiber batt 92 on the inside 88 of the fiber/base composite structure 94. After the polymeric resin material 100 is cured, it is ground and/or polished to provide it with desired surface characteristics and the calender belt 80 as a whole with a uniform thickness. As before, the grinding and/or polishing does not expose any fiber or yarn of the fiber/base composite structure 94, so that the calender belt 80 has a layer 102 of polymeric resin material 100 of desired thickness over the staple fiber batt 92 on the inside 88 of the fiber/base composite structure 94. Calender belt 80 is also of the variety usable in both a roll-type and a shoe-type calender.

Figure 5:
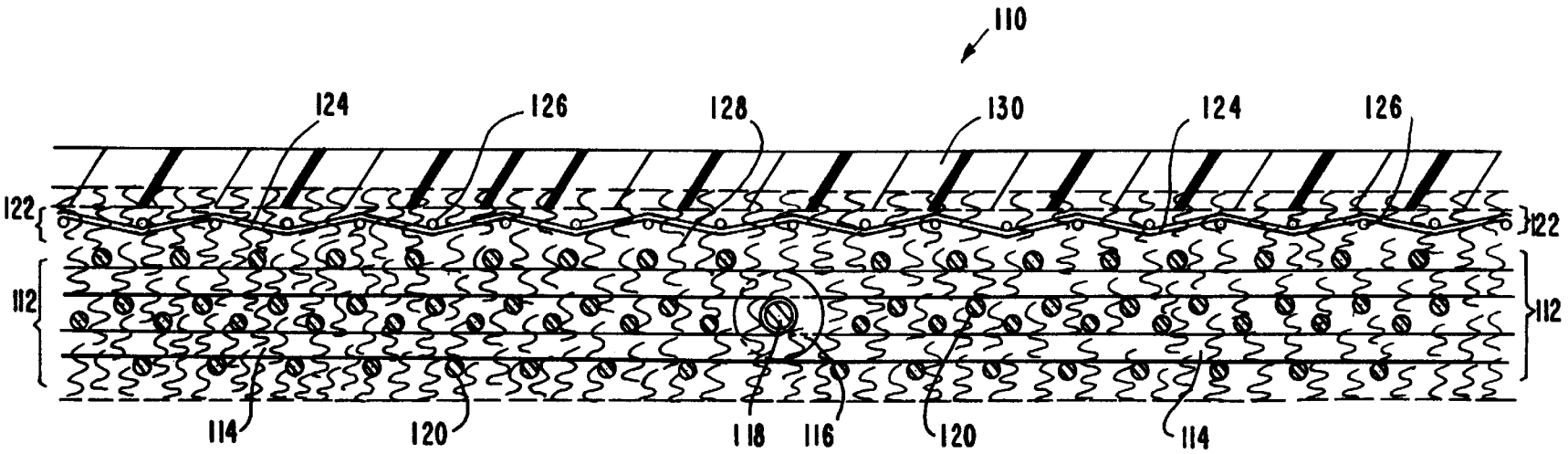
FIG. 5 is a cross-sectional view, taken in the machine direction, of a fifth embodiment of the calender belt.

A fifth embodiment of the calender belt 110 is shown in cross section in FIG. 5. In this cross-sectional view, which is taken in the machine direction, the calender belt 110 may be seen to have a laminated structure as a base substrate which comprises a primary base layer 112.

The primary base layer 112 is woven from monofilament yarns in a two-layer, or duplex, weave. Machine-direction yarns 114, which are the weft yarns in the on-machine-seamable fabric used as primary base layer 112, form seaming loops 116 which are interdigitated to create a passage through which a pintle 118 is directed to join the primary base layer 112 into endless form. Cross-machine direction yarns 120, which are the warp yarns during the weaving of the primary base layer 112, are, like the machine-direction yarns 114, monofilament yarns.

Primary base layer 112 need not be an on-machine-seamable fabric, although this is preferred because it would permit the calender belt 110 to be installed on calenders which are not cantilevered. Where the calender is cantilevered primary base layer 112, and, it follows, calender belt 110, may be endless.

A secondary base layer 122 is attached to the outside of the primary base layer 112. That is to say, more specifically, secondary base layer 122 is attached to the outer surface of the endless loop formed by the primary base layer 112.

Secondary base layer 122 is of a single-layer weave, such as a plain weave, and may be joined into endless form by a woven seam, or may be woven endless. Secondary base layer 122 is woven from machine-direction yarns 124 and cross-machine direction yarns 126, both of which may be monofilament yarns. Yarns other than monofilament yarns may be used in the weaving of secondary base layer 122.

Secondary base layer 122 is placed on top of primary base layer 112, and placed into endless form therearound by a pin seam if it is an on-machine-seamable fabric. The primary base layer 112 and secondary base layer 122 are then attached to one another by needling a staple fiber batt 128 through the secondary base layer 122 and into the primary base layer 112, building up a layer of staple fiber batt 128 above secondary base layer 122. Staple fiber batt 128 is also needled through the underside of primary base layer 112. If required, staple fiber batt 128 may also be needled directly onto the underside of primary base layer 112.

At least one or several layers of polyurethane resin 130 are then applied to the staple fiber batt 128 above secondary base layer 122. The resin 130 penetrates into staple fiber batt 128, but not into or through secondary base layer 122, although resin 130 may penetrate right up to the surface of secondary base layer 122. The resin 130 is built up to a desired thickness over the staple fiber batt 128. Once the desired thickness is reached, the polyurethane resin 130 is cured, and, once cured, is ground to a uniform thickness without exposing any of the staple fiber batt 128.

Where the primary base layer 112 is an on-machine-seamable fabric, as represented in FIG. 5, the penetration of the polyurethane resin 130 is controlled so that the seaming loops 116 remain open, that is, free of the resin 130. In that way, following the curing and grinding of the polyurethane resin 130, the pintle 118 may be removed, and the resin 130 and secondary base layer 122 cut above, but without damaging, the seaming loops 116, to place the calender belt 110 into flat, unseamed form for shipment and subsequent installation on a calender which is not cantilevered. Installation proceeds by interdigitating the seaming loops 116, and by directing a pintle 118 through the passage defined by the interdigitated seaming loops 116. A resin may then be applied to the cut in the resin layer 130 to close the cut and make the seam impermeable. The resin may then be cured and ground to blend in with the rest of the resin layer 130.

The present calender belts present numerous advantages not found in the calender belts of the prior art.

The presence of a staple fiber batt attached to one or both surfaces of the base substrate enables the calender belt manufacturer to control the depth that the resin penetrates into the belt. That is, the batt fiber ensures that the resin penetration is substantially uniform to a depth anywhere from partly to completely through the fiber/base composite structure. Where the fabric is to be coated on only one side, a smaller amount of resin and fewer coating passes may be required to build up a desired thickness, as the presence of batt fibers can keep the resin from penetrating into, within or through the base substrate. Further, without the staple fiber batt, the penetration of the resin into the base substrate is quite non-uniform. As previously discussed, non-uniformities are unacceptable in a calender belt because they cause localized areas of high pressure in the nip. This, in turn, imparts a non-uniform gloss to the sheet being calendered, giving it a blotchy appearance. Further, where belts are coated on both sides, non-uniform resin penetration can lead to localized areas of poor bonding and consequent resin delamination during use. The use of staple fiber batt to control the depth of resin penetration solves both of these problems.

Further, the staple fiber batt acts to tie the polyurethane resin to the base substrate, and eliminates the need for a tie coat or inner layer, thereby preventing resin delamination therefrom because of the higher coating surface area presented by the staple fiber batt as compared to a base substrate lacking a staple fiber batt.

The staple fiber batt also becomes part of a fiber-reinforced resin matrix, which eliminates interlayer delamination, that is, delamination of built-up resin layers from one another. As an additional advantage, a fiber-reinforced resin matrix is less vulnerable to stress cracking and crack propagation. Further, the resin coating may be thicker than has heretofore been possible, because the resin coating is reinforced with the staple fiber batt.

The staple fiber batt also gives the calender belt a greater compressibility in the Z-direction, and perhaps a greater elastic recovery, than the calender belts of the prior art.

Resin systems for calender belts must be soft enough to allow the calender belts to deform to provide a compliant nip. If the resin system is too soft, however, it will not have sufficient durability to provide long service life and will fatigue. On the other hand, if the resin system is too hard, it will not be compliant enough to provide the advantages of a compliant or soft nip calender. The presence of a staple fiber batt in the present calender belts allows a soft resin to be used to obtain compliancy in the nip and still maintain its structural integrity and resiliency.

Finally, the staple fiber batt permits a thicker and heavier calender belt to be manufactured than is practical with a non fiber batt containing base substrate, because the staple fiber batt reduces the hysteresis effects caused by repeated compression and relaxation of the calender belt.

The present calender belt may be used in any type of calender: roll, multiple roll or shoe calender, although, for use on the latter, the calender belt must have a polymeric resin coating on its inner surface for contact with the oil-lubricated press shoe, as is the case for a long nip press belt. In other words, the resin must completely cover both surfaces of the fiber/base composite structure, if the calender belt is to be used on a shoe calender.

The following are examples of the present invention, and should not be construed to limit those claimed below.

EXAMPLE I

A base substrate having a primary base layer and a secondary base layer was manufactured. The primary base layer was of a duplex weave having 0.35 mm MD (machine-direction) monofilament yarns and 0.40 mm CD (cross-machine-direction) monofilament yarns. The MD yarn density was 100 yarns/decimeter, and the CD yarn density was 157 yarns/decimeter, in this primary base layer.

The secondary base layer was of a single-layer weave having 0.25 mm MD monofilament yarns and 4-ply 0.20 mm CD monofilament yarns, that is, plied monofilament yarns having four 0.20 mm monofilament strands.

The base substrate, comprising the primary and secondary base layers, had a mass of 855 grams/$m^2$.

Batt fiber of 11 dtex (10 denier) was applied and attached to the base substrate by needling. The batt fiber was applied in a density of 1135 grams/$m^2$ , 10% of which was applied to the backside (primary base layer) of the base substrate. The total mass per unit area of the fiber/base composite structure (base substrate and staple fiber batt) was 1990 grams/$m^2$.

This fiber/base composite structure was further processed to leave it with a density of 0.423 grams/$cm^3$ and a thickness of 0.467 cm.

A polyurethane resin coating having a viscosity of 6000 cps was applied via multiple passes to the top side (secondary base layer) of the fiber/base composite substrate. The resin layer was built up slightly above the top surface fiber plane. The resin-impregnated fiber/base composite structure was exposed to heat to dry and cure the resin. Surface grinding was carried out to provide the required smoothness without exposing any surface batt fiber. The final thickness of the resulting belt was 0.483 cm.

Examination of a cross section of the belt revealed that the resin had penetrated only to the surface of the secondary base layer, and that the resin "coating" was present in approximately 40% of the thickness of the belt.

Without the presence of the batt fiber, the resin would have penetrated into and through the primary and secondary base layers of the base substrate, for all intents and purposes encapsulating them. Since the primary and secondary base layers made up about 60% of the total thickness of the belt, much more resin would have to be applied to make a belt of the same total thickness of 0.483 cm. This would be costly in terms of both resin (material cost) and processing time. In addition, the neutral axis of bending of the belt was much closer to the coated surface than it would have been if the primary and secondary base layers were totally impregnated.

EXAMPLE II

The same fiber/base composite structure as in Example I was made and processed. A polyurethane resin coating having a viscosity of 9000 cps was used, again being applied via multiple passes to the top side (secondary base layer) of the fiber/base composite substrate. The resin layer was built up slightly above the top surface fiber plane. The resin-impregnated fiber/base composite structure was exposed to heat to dry and cure the resin. Surface grinding was carried out to provide the required smoothness without exposing any batt fiber.

Examination of a cross section of the belt revealed that the resin had penetrated into the batt fiber portion, but had not reached the secondary base layer. Again, without the presence of the batt fiber, the resin would have penetrated into and through the primary and secondary base layers of the base substrate.

In general, the specifics of the construction of the fiber/base composite structure and the type of polymeric resin, and its properties including viscosity, used to coat the fiber/base composite structure, are within the control of the belt manufacturer. For example, if the fiber/base composite structure used in Examples I and II were modified either by increasing its density by reducing its initial thickness, or by changing the size of the batt fiber to a finer material, such as 3.3 dtex (3 denier), the resin system used in Example I would have penetrated a smaller, substantially uniform distance into the batt structure.

A series of experiments wherein the specifics of the construction of the fiber/base composite structure, the resin systems used and the coating processes could be varied would yield data sets that would enable one to predict the depth of penetration of the particular resin, processed in a particular manner, for a given fiber/base composite structure.

Modifications to the above would be obvious to those of ordinary skill in the art, but would not bring the invention so modified beyond the scope of the appended claims.

What is claimed is:

1. A calender belt for the compliant calendering of a paper or paperboard web, said calender belt comprising:

a base substrate, said base substrate being in the form of an endless loop and having an outer side and an inner side;

a first staple fiber batt attached to said outer side of said base substrate;

a second staple fiber batt attached to said inner side of said base substrate, said base substrate, said first staple fiber batt and said second staple fiber batt together being a fiber/base composite structure; and a first polymeric resin material impregnating said fiber/base composite structure to a uniform depth therewithin, said first polymeric resin material forming a layer over said first staple fiber batt on said outer side of said base substrate and having a ground and polished surface, whereby, upon grinding and polishing, none of said first staple batt is exposed on said ground and polished surface, so that said first polymeric resin material may be provided with desired surface characteristics and said calender belt may have a uniform thickness.

2. A calender belt as claimed in claim 1 wherein said base substrate is a fabric selected from the group consisting of woven, nonwoven, knitted and braided fabrics.

3. A calender belt as claimed in claim 1 wherein said base substrate is an extruded sheet of a polymeric resin material.

4. A calender belt as claimed in claim 1 wherein said base substrate is an extruded mesh fabric.

5. A calender belt as claimed in claim 1 wherein said base substrate is a spiral-link fabric.

6. A calender belt as claimed in claim 1 wherein said base substrate is a strip material spirally wound in a plurality of turns, each turn being joined to those adjacent thereto by a continuous seam, said base substrate being endless in a longitudinal direction, said strip material being selected from the group consisting of woven fabrics, nonwoven fabrics, knitted fabrics, braided fabrics, extruded sheets of polymeric material and extruded mesh fabrics.

7. A calender belt as claimed in claim 1 wherein said base substrate is an on-machine-seamable fabric.

8. A calender belt as claimed in claim 1 wherein said base substrate is a laminated structure comprising at least two base layers.

9. A calender belt as claimed in claim 8 wherein said at least two layers are a primary base layer and a secondary base layer.

10. A calender belt as claimed in claim 9 wherein said primary base layer is an endless loop within an endless loop formed by said secondary base layer, said outer side of said base substrate is an outer side of said secondary base layer, and said first polymeric resin material impregnates said fiber/base composite structure up to said outer side of said secondary base layer.

11. A calender belt as claimed in claim 9 wherein at least one of said primary base layer and said secondary base layer is a fabric selected from the group consisting of woven, nonwoven, knitted and braided fabrics.

12. A calender belt as claimed in claim 9 wherein at least one of said primary base layer and said secondary base layer is an extruded sheet of a polymeric resin material.

13. A calender belt as claimed in claim 9 wherein at least one of said primary base layer and said secondary base layer is an extruded mesh fabric.

14. A calender belt as claimed in claim 9 wherein at least one of said primary base layer and said secondary base layer is a spiral-link fabric.

15. A calender belt as claimed in claim 9 wherein at least one of said primary base layer and said secondary base layer is a strip material spirally wound in a plurality of turns, each strip being joined to those adjacent thereto by a continuous seam, said at least one of said primary base layer and secondary base layer being endless in a longitudinal direction, said strip material being selected from the group consisting of woven fabrics, nonwoven fabrics, knitted fabrics, braided fabrics, extruded sheets of polymeric material and extruded mesh fabrics.

16. A calender belt as claimed in claim 9 wherein at least one of said primary base layer and said secondary base layer is an on-machine-seamable fabric.

17. A calender belt as claimed in claim 1 wherein said first staple fiber batt is attached by needling.

18. A calender belt as claimed in claim 1 wherein said first staple fiber batt is attached by hydroentanglement.

19. A calender belt as claimed in claim 1 wherein said first staple fiber batt is attached by heat fusing.

20. A calender belt as claimed in claim 1 wherein said first staple fiber batt is attached by melt fiber.

21. A calender belt as claimed in claim 1 wherein said first staple fiber batt is attached by fusible fiber layers.

22. A calender belt as claimed in claim 1 wherein said second staple fiber batt is attached by needling.

23. A calender belt as claimed in claim 1 wherein said second staple fiber batt is attached by hydroentanglement.

24. A calender belt as claimed in claim 1 wherein said second staple fiber batt is attached by heat fusing.

25. A calender belt as claimed in claim 1 wherein said second staple fiber batt is attached by melt fiber.

26. A calender belt as claimed in claim 1 wherein said second staple fiber batt is attached by fusible fiber layers.

27. A calender belt as claimed in claim 1 wherein said first polymeric resin material impregnates said fiber/base composite structure without reaching said base substrate.

28. A calender belt as claimed in claim 1 wherein said first polymeric resin material impregnates said fiber/base composite structure to a depth within said base substrate.

29. A calender belt as claimed in claim 1 wherein said first polymeric resin material impregnates completely through said fiber/base composite structure.

30. A calender belt as claimed in claim 1 further comprising:

a second polymeric resin material forming a layer on said inner side of said base substrate of said fiber/base composite structure and having a ground and polished surface, whereby, upon grinding and polishing, none of said base substrate is exposed on said ground and polished surface, so that said second polymeric resin material may be provided with desired surface characteristics and said calender belt may have a uniform thickness.

31. A calender belt as claimed in claim 1 further comprising:

a second polymeric resin material impregnating said fiber/base composite structure to a uniform depth therein, said second polymeric resin material forming a layer over said second staple fiber batt on said inner side of said base substrate and having a ground and polished surface, whereby, upon grinding and polishing, none of said second staple fiber batt is exposed on said ground and polished surface, so that said second polymeric resin material may be provided with desired surface characteristics and said calender belt may have a uniform thickness.

* * * * *